United States Patent [19]

Schaus

[11] Patent Number: 4,463,896

[45] Date of Patent: Aug. 7, 1984

[54] METHODS AND APPARATUS FOR THE CONTROL OF SMOKE AND FIRE IN BUILDINGS

[76] Inventor: Herbert J. Schaus, 4853 Wolf Way, Concord, Calif. 94521

[21] Appl. No.: 357,143

[22] Filed: Mar. 11, 1982

[51] Int. Cl.[3] ..... F24F 13/14

[52] U.S. Cl. ..... 236/49; 98/1; 98/43 R

[58] Field of Search ..... 236/49; 98/1, 42 R, 98/43 R, 43 A, 86; 169/54, 56

[56] References Cited

U.S. PATENT DOCUMENTS

| | | | |
|---|---|---|---|
| 3,738,429 | 6/1973 | Heller et al. | 169/54 X |
| 3,739,707 | 6/1973 | Knapp | 236/49 X |
| 3,741,101 | 6/1973 | Sheppard | 98/86 |
| 3,826,180 | 7/1974 | Hayashi | 98/43 |
| 4,084,744 | 4/1978 | Wilson, Jr. | 236/49 |

FOREIGN PATENT DOCUMENTS

| | | | |
|---|---|---|---|
| 1438002 | 6/1976 | United Kingdom | 169/56 |

*Primary Examiner*—William E. Tapolcai
*Attorney, Agent, or Firm*—Rankin A. Milliken

[57] ABSTRACT

Smoke and fire control devices and systems are disclosed, including smoke control devices which are responsive to smoke to evacuate smoke and also responsive to elevated temperatures to terminate the evacuation of smoke. Other disclosed smoke control devices comprise valving means which also function as curtain boards, and second valving means which serve to terminate the evacuation of smoke when the temperature of the evacuated smoke and other gases becomes excessive.

7 Claims, 15 Drawing Figures

METHODS AND APPARATUS FOR THE CONTROL OF SMOKE AND FIRE IN BUILDINGS

BACKGROUND OF THE INVENTION

1. Field of the Invention

My invention relates to methods and apparatus for the control of smoke and fire in buildings.

2. Description of the Prior Art

The term "prior art" as used herein or in any statement made by or for applicant means only that any document or thing referred to as prior art bears, directly or inferentially, a date which is earlier than the effective filing date hereof.

Smoke control systems for buildings are known in the art, and are disclosed, for example, in at least some of the patents listed hereinbelow.

The following United States patents were adduced by a preliminary patentability search, and thus it is believed that each of them contains information which might be considered to be material to the examination of this application. No representation or admissions are made by the citation of these patents: U.S. Pat. Nos. 3,734,114; 3,350,996; 3,739,707; 3,741,101; 3,786,739; 3,800,687; 3,818,816; 3,821,923; 3,884,133; 3,912,223; 3,951,051; 3,955,323; 3,981,317; 4,033,246; 4,047,475; 4,058,253; 4,080,978; 4,243,175.

However, none of the smoke or smoke and fire control methods or apparatus of the prior art appear to achieve the degree of control of the smoke and fire produced by building fires which is desired by fire safety systems designers and fire safety authorities.

SUMMARY OF THE INVENTION

Accordingly, it is an object of my invention to provide methods and apparatus for exhausting smoke and hot gases from buildings during fires and thus improving access and visibility for fire fighting efforts, which methods and apparatus function more efficiently than do those of the prior art.

It is another object of my invention to provide methods and apparatus for exhausting smoke and hot gases from buildings during fires, and thus to allow enough time for persons to evacuate the premises without harm, and further allow fire fighting efforts to proceed rapidly because less time is required to locate the seat of the fire, which methods and apparatus function more efficiently than do those of the prior art.

It is yet another object of my invention to provide apparatus for exhausting smoke and hot gases from buildings during fires, which apparatus is less complex and costly and more easily maintained without the employment of highly specialized and expensive maintenance labor than is the case with the methods and apparatus of the prior art.

It is a further object of my invention to provide methods and apparatus for increasing the operating efficiency of building fire control sprinkler systems.

It is yet a further object of my invention to provide smoke or smoke and fire control systems which are adapted for wide application, i.e., in residences as well as commercial buildings.

It is an additional object of my invention to provide smoke or smoke and fire control systems which can be readily installed in many existing buildings without the retrofitting of duct systems.

Other objects of my invention will in part be obvious and will in part appear hereinafter.

My invention, accordingly, comprises the several steps and the relation of one or more of such steps with respect to each of the others, and the apparatus embodying features of construction, combinations of elements, and arrangements of parts, which are adapted to effect such steps, all as exemplified in the following disclosure, and the scope of the present invention will be indicated in the appended claims.

In accordance with a principal feature of the present invention, smoke and fire control systems are provided which comprise smoke control valve means, smoke responsive means for opening said valve means in response to the presence of smoke in the vicinity of said valve means, and heat responsive means for closing said valve means in response to heat in the vicinity of said valve means.

In accordance with another principal feature of my invention, such smoke and fire control systems further comprise means for initiating the operation of smoke extracting means for extracting smoke from the vicinity of said valve means when smoke is present in the vicinity of said valve means.

In accordance with yet another principal feature of my invention, smoke and fire control systems for buildings comprise smoke exhaust control valves which also function as curtain boards.

In accordance with an additional principal feature of my invention, smoke and fire control systems for buildings comprise valve means which normally close smoke exhaust duct openings, and which drop downward to unblock said openings and at the same time function as curtain boards in response to the occurrence of smoke in the vicinity of a particular one of said openings.

In accordance with a yet further feature of my invention, a smoke and fire control valve for controlling the passage of smoke through a smoke exhaust duct opening comprises first and second valve means for selectively opening or closing said opening.

In accordance with another feature of my invention, one of said valve means is controlled by the presence of smoke in the vicinity of said opening, and the other one of said valve means is controlled by the temperature of the smoke and hot gases passing through said opening.

In accordance with another feature of my invention, the lower one of said two valve means is so constructed and arranged as to serve as a curtain board when it is not blocking said opening For a fuller understanding of the nature and objects of my invention, reference should be had to the following detailed description, taken in connection with the accompanying drawings.

DETAILED DESCRIPTION OF PREFERRED EMBODIMENTS OF THE INVENTION

As will hereinafter become apparent to those having ordinary skill in the fire protection engineering art, the following detailed description comprises two principal parts, viz., (1) a detailed description of certain methods, apparata, and systems embodying my invention which are sometimes referred to herein as "smoke control" methods, apparata, and systems, and (2) a detailed description of certain methods, apparata, and systems embodying my invention which are sometimes referred to herein as "fire control" methods, apparata, and systems.

As will be made apparent hereinafter, smoke control methods, apparata, and systems embodying my invention have a relatively broad field of application, ranging from small residences to large hotels, office buildings, warehouses, and factories; whereas fire control methods, apparata, and systems embodying my invention, which comprise conventional automatic sprinkler methods, apparata, and systems, have a relatively limited field of application, i.e., large buildings, such as hotels, office buildings, warehouses, factories, and the like, wherein the provision of automatic sprinkler systems is economically justified or legally required.

Figure 1:
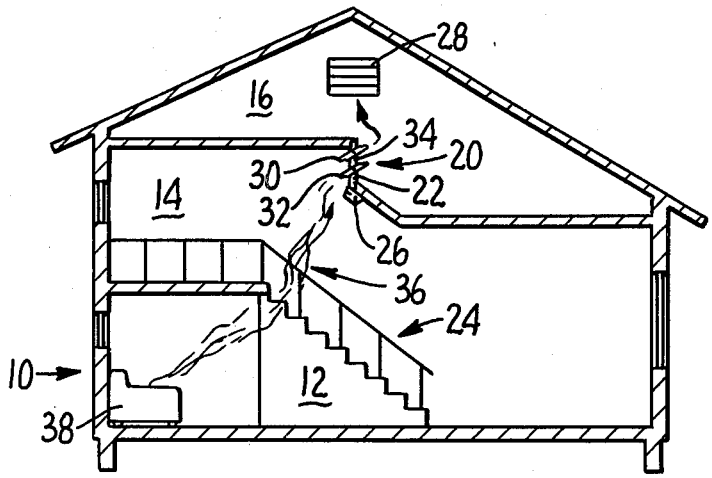
FIG. 1 is a sectional view in elevation of a small residence equipped with a smoke control system of my invention.

Referring now to FIG. 1, there is shown in cross-section a small residence 10 which is provided with a smoke control system embodying my invention.

Figure 2:
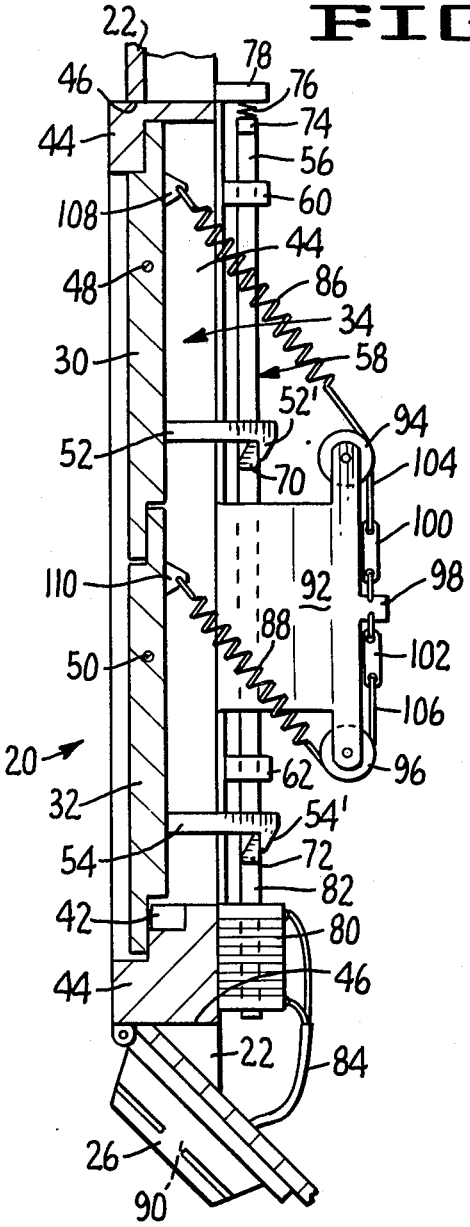
FIGS. 2 and 3 are elevational views in section of a smoke control valve embodying my invention in two different states of operation.
Figure 3:
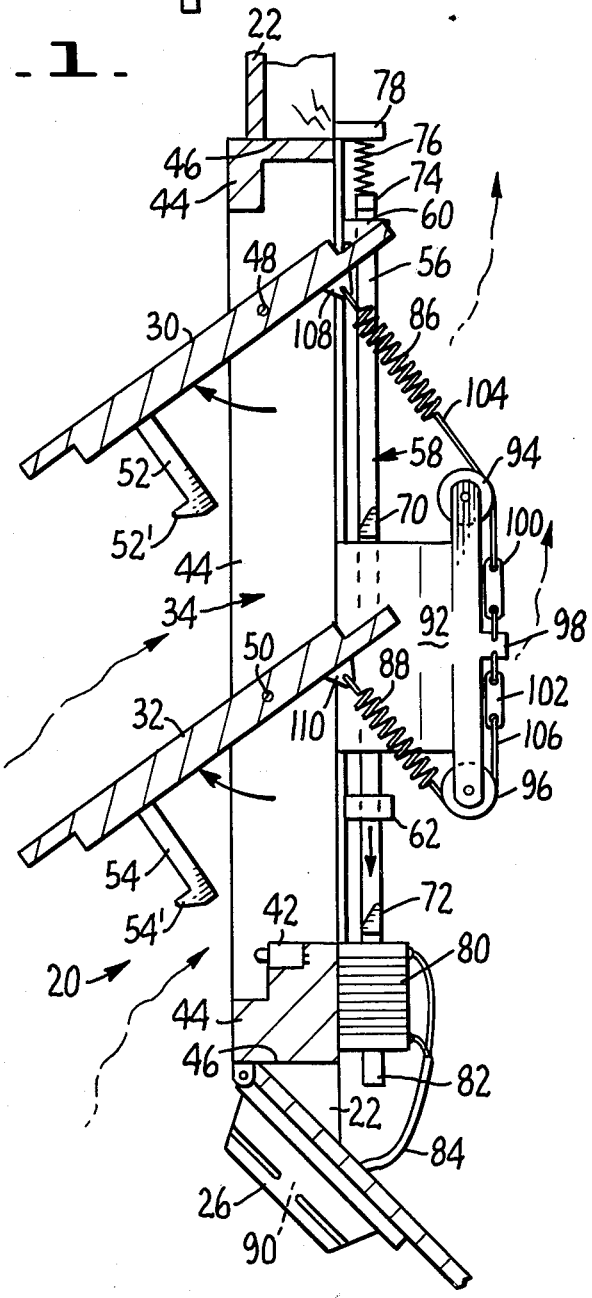

As seen in FIG. 1, residence 10 comprises a lower floor 12, an upper floor 14, and an attic or crawl space 16. A smoke control device 20 embodying my invention is installed in a vertical partition 22 located between upper floor 14 and attic or crawl space 16, directly above a staircase 24. Smoke control device 20 is shown in FIGS. 2 and 3, and will be described in detail hereinafter in connection with those figures.

Returning to FIG. 1, there is shown a smoke detector housing 26 containing a smoke detector of well-known type, such as a photoelectric type smoke detector or an ionization type smoke detector. Smoke detector housing 26 and the smoke detector it contains are both parts of smoke detector device 20.

As also seen in FIG. 1, attic or crawl space 16 is provided with at least one ventilator 28, which is a shielded opening communicating directly between attic 16 and the free space outside residence 10.

As also seen in FIG. 1, smoke control device 20 comprises a pair of louvers 30, 32 by means of which an air and smoke opening 34 defined by the frame of smoke control device 20 and extending between upper floor 14 and attic 16 can selectively be opened or closed.

As explained hereinbelow in connection with FIGS. 2 and 3, louvers 30, 32, which are normally closed, are provided with spring means by which they are resiliently biased toward their open position, and are further provided with solenoid operated latching means whereby they are normally latched in their closed position, but can be released to assume their open position when the latch operating solenoid means is momentarily energized in response to a signal produced by the smoke detector contained in housing 26. This smoke detector produces a solenoid energizing signal whenever it is excited by a quantity of smoke in its immediate vicinity in excess of a predetermined quantity.

It is to be particularly noted that in accordance with principles of my invention the smoke detector in housing 26 may be made less sensitive than the common household smoke detectors, or provided with signal integrating means which prevent the occurrence of the solenoid energizing signal unless excessive smoke has been detected for a predetermined interval, or both.

As explained in detail hereinafter in connection with FIGS. 2 and 3, smoke control device 20 further comprises heat responsive means whereby louvers 30, 32 are released to assume their closed position under the influence of gravity whenever the temperature of the air and smoke passing through opening 34 exceeds a predetermined value.

In view of the above, then, it will be seen by those having ordinary skill in the art that the method of operation of the smoke control device 20 of my invention can be described as follows.

1. Smoke 36 from a fire in residence 10, e.g., a fire in sofa 38, rises in the known manner and reaches the smoke detector in housing 26.

2. The smoke detector in housing 26 energizes a release mechanism, allowing the springs associated with louvers 30, 32 to move louvers 30, 32 to their open position.

3. The smoke detector in housing 26 also energizes an exhaust fan 40 (not shown in FIG. 1) associated with ventilator 28, and thus smoke 36 is withdrawn from the living spaces of residence 10 through opening 34, giving the occupants time to depart of safely take steps to extinguish the fire in sofa 38 without danger of asphyxiation.

4. If the fire in sofa 38 is not extinguished, but rather grows in intensity, the temperature of the air and smoke passing through opening 34 actuates said heat responsive means, and thus louvers 30, 32 are released to return to their closed position under the influence of gravity, eliminating the draft created by exhaust fan 40 which otherwise would continue to exacerbate the fire which originated in sofa 38.

5. In the particular embodiment of my invention installed in residence 10 said heat responsive means also serves to de-energize exhaust fan 40. By way of example only, a snap-action switch 42 (FIGS. 2 and 3) may be operated by louver 32 to alternately energize and de-energize exhaust fan 40.

Referring now to FIGS. 2 and 3, the construction and operation of smoke control device 20 will be explained in detail.

FIG. 2 shows smoke control device 20 in its "louvers closed" state; and FIG. 3 shows smoke control device 20 in its "louvers open" state.

In these figures, the vertical partition in which smoke control device 20 is mounted is designated by the reference numeral 22.

The principal body portion of smoke control device 20 is an open frame 44 which defines the abovesaid smoke opening 34. Frame 44 is fixedly mounted in a close-fitting opening 46 cut in partition 22 for that purpose, and is preferably air-tightly sealed in opening 46 by means well-known to those having ordinary skill in the fire protection engineering art.

Louvers 30, 32 are pivotably mounted on pivot rods 48, 50 respectively. Pivot rods 48, 50 are themselves fixedly mounted in suitable corresponding pairs of bores in the side walls of frame 44. Thus, louver 30 is pivotable about the axis of pivot rod 48, which itself is immovable with respect to frame 44; and louver 32 is pivotable about the axis of pivot rod 50, which itself is immovable with respect to frame 44.

As may be seen in FIGS. 2 and 3, the axis of pivot rod 48 is located well above the center of gravity of louver 30, and thus louver 30 has a natural tendency to assume its closed position unless acted upon by external forces other than gravity. Similarly, louver 32 has a natural tendency to assume its closed position unless acted upon by external forces other than gravity.

A latching hook 52 is fixedly mounted upon louver 30 so as to be immovable with respect to louver 30; and a latching hook 54 is fixedly mounted upon louver 32 so as to be immovable with respect to louver 32.

A vertical side member 56 of a latching yoke 58 is mounted upon the rear face of one side member of frame 44 by means of slide brackets 60 and 62. Similarly, a second vertical side member 64 (not shown) of latching yoke 58 is mounted upon the other side member of frame 44 by means of slide brackets 66 and 68 (not shown). The side members 56 and 64 of latching yoke 58 are rigidly interconnected by means of two latching bars 70, 72.

Thus, it will be seen that latching yoke 58 takes the form of a rigid frame, consisting principally of side members 56 and 64 and latching bars 70 and 72, which are rigidly affixed to side members 56 and 64.

As will also be evident to those having ordinary skill in the art, informed by the present disclosure, latching yoke 58 is vertically slidable with respect to frame 44, but mounted at a fixed distance therefrom, by means of slide brackets 60, 62, 66, and 68.

Further, the upper ends of side members 56 and 64 are interconnected by means of a straight structural member 74, to which is attached a coil spring 76. The upper end of coil spring 76 is affixed to a bracket 78 which is itself affixed to the upper transverse member of frame 44. Thus, latching yoke 58 is spring-biased toward its uppermost position, which may be determined by a suitable stop (not shown).

As also seen in FIGS. 2 and 3, a solenoid 80 is affixed to the lower transverse member of frame 44. The upper end of the plunger 82 of solenoid 80 is affixed to latching bar 72, preferably centrally thereof.

As will now be apparent to those having ordinary skill in the art, informed by the present disclosure, whenever solenoid 80 is energized by its energizing connections 84 latching yoke 58 is drawn downwardly against the urging of spring 76 at least far enough so that latching bars 70 and 72 clear the lower ends of the hook portions 52', 54' of their respective associated latching hooks 52 and 54.

As also seen in FIGS. 2 and 3, louver 30 is resiliently biased toward its open position by a coil spring 86; and louver 32 is resiliently biased toward its open position by a coil spring 88.

In accordance with the principles of my invention, energizing current for solenoid 80 is provided by a smoke detector circuit 90 contained within smoke detector housing 26 whenever the concentration of smoke in housing 26 exceeds a predetermined value. Smoke detector circuits suitable for use as smoke detector 90 are well-known to those having ordinary skill in the fire protection engineering art, and will be provided by the same without the exercise of invention. In the embodiment of FIGS. 2 and 3, housing 26 contains a suitable battery (not shown) by means of which energy for operating smoke detector circuit 90 and solenoid 80 is provided. It is to be understood, however, that in alternative embodiments of my invention smoke detector circuit 90, and thus solenoid 80, will preferably be power-line operated, since it is well-known to those having ordinary skill in the art that vandals are sometimes prone to steal the operating power supplying batteries even of safety devices upon which the preservation of human lives may depend.

Returning to FIGS. 2 and 3, it will be seen that a bracket 92 affixed to one side member of frame 44 has journalled upon it a pair of pulleys 94, 96. Bracket 92 also includes an ear 98 to which are affixed respective ends of two fusible links 100, 102. Links 100, 102 are fabricated from Wood's metal or other suitable materials, so configured and compounded as to melt at the smoke and air temperature at which it is desired that louvers 30 and 32 automatically close. The ends of fusible links 100, 102 opposite ear 98 are respectively connected to the ends of coil springs 86 and 88 remote from louvers 30, 32 by means of cable segments 104 and 106. The other ends of coil springs 86 and 88 are connected respectively to louvers 30, 32 by means of suitable ears 108, 110.

Also seen in FIGS. 2 and 3 is the snap-action switch 42 by means of which the abovesaid exhaust fan 40 is energized (when louvers 30, 32 are open), and de-energized (when louvers 30, 32 are closed)

As will now be apparent to those having ordinary skill in the art, informed by the present disclosure, the smoke control device 20 of the particular embodiment of my invention shown in FIGS. 1 through 3 operates as follows.

Smoke control device 20 is normally closed, as shown in FIG. 2.

When smoke detector circuit 90 experiences a level of smoke concentration in excess of said predetermined value, solenoid 80 is energized, and thus latching yoke 58 is drawn downwardly against the urging of spring 76.

When latching bars 70 and 72 are deflected below the lower ends of latching hook portions 52', 54', louvers 30, 32, under the urging of coil springs 86, 88, respectively, spring to their open positions, thus permitting smoke 36 to enter attic 16 through opening 34.

At the same time, the closing of switch 42, occasioned by the opening of louver 32, energizes said exhaust fan 40, which results in the reduction of the air pressure in attic 16. It follows that the smoke 36 produced by the fire in sofa 38 is drawn into attic 16 through opening 34, rather than being allowed to collect in residence 10 and thus make both egress from residence 10 and attempts to suppress the fire in sofa 38 hazardous, due to the danger of smoke inhalation and asphyxiation.

It will also now be apparent to those having ordinary skill in the art that if the fire which started in sofa 38 is not rapidly extinguished, but rather grows in intensity, the temperature of the smoke and air passing through opening 34 will rise until it reaches said predetermined value, at which time fusible links 100, 102, will melt, and louvers 30, 32 will return to their closed positions, cutting off the draft which would otherwise tend to exacerbate the fire which originated in sofa 38. At the same time, upon the return of louver 32 to its closed position, switch 42 is opened, and thus exhaust fan 40 is de-energized.

It is to be particularly noted that smoke control methods apparatus, and systems of my invention are not limited to the particular smoke control device and system 20 described hereinabove, nor to the method of operation thereof which is described hereinabove.

Figure 4:
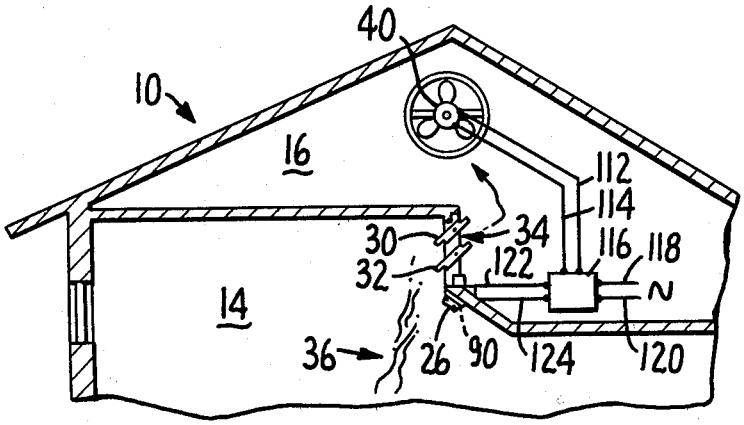
FIG. 4 is a partial sectional view in elevation of a small residence equipped with a smoke control system of my invention.

For example, the ambient pressure in attic 16 may be reduced by exhaust fan 40 (FIG. 4) which is powered by line current supplied via conductors 112, 114, which themselves are connected to the output terminals of a relay 116, which is connected to power line conductors 118, 120, and controlled by smoke detector circuit 90 via control conductors 122, 124.

Alternatively, it may be sufficient in some systems embodying my invention to rely upon naturally occurring air circulation to reduce the ambient pressure in attic 16, and thus withdraw smoke 36 from residence 10.

Further, the louvers of the smoke control device or devices of certain embodiments of my invention may be increased in number above two, and may be driven by suitable servo motor means, rather than solenoid operated.

Yet further, the louvers of the smoke detector or detectors of certain embodiments of my invention may be servomotor driven to their closed positions under the control of a suitable bimetal switch or the like, whereby the necessity for replacing fusible links after each operation of the smoke control device is eliminated.

In each embodiment of the smoke control devices and systems of my invention, however, there is provided smoke control valve means, smoke responsive means for opening said valve means in response to the presence of smoke in the vicinity of said valve means, and heat responsive means for closing said valve means in response to heat in the vicinity of said valve means which exceeds a predetermined value.

It is further to be understood that the smoke control devices and systems of my invention are not limited to use in small residences, and indeed not limited to use in residences.

Figure 5:
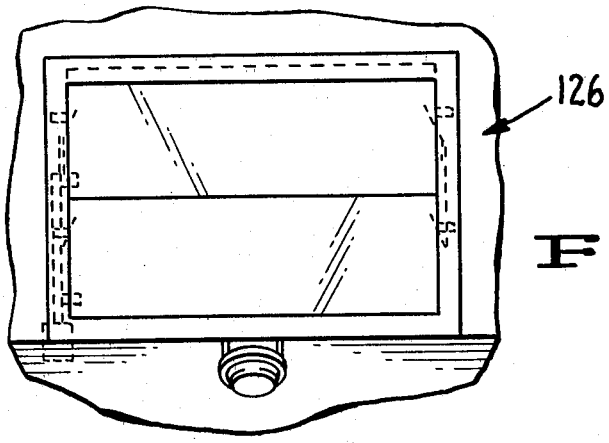
FIG. 5 is a pictorial view of a smoke control valve of my invention which is substantially identical to the smoke control valve shown in FIGS. 2 and 3.
Figure 6:
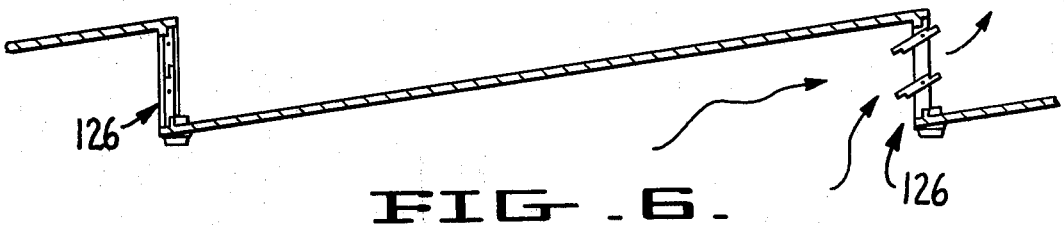
FIGS. 6 and 7 show in elevational cross-section two commercial building ceiling constructions which are particularly adapted to the incorporation of a smoke control system of my invention.
Figure 7:
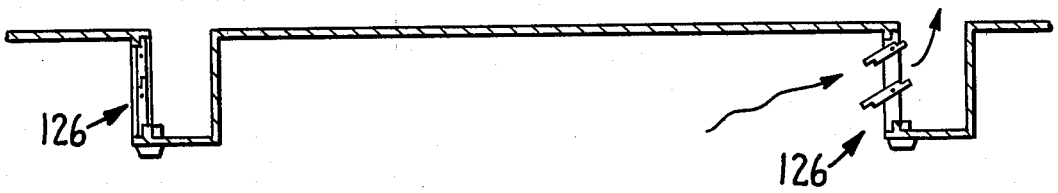

For example, a smoke control valve 126 (FIG. 5), generally resembling smoke control valve 20 but of more rugged construction, may be, within the scope of my invention, used in the roofs of warehouses or other industrial buildings (FIG. 6), or in the ceilings of corridors of hotels and the like (FIG. 7). The style of roofs or corridor ceilings shown in FIGS. 6 and 7 are to be understood to constitute particular features of my invention, since while embodying my invention they at the same time provide segmentation of the roof or ceiling area in the manner of well-known curtain boards.

Figure 8:
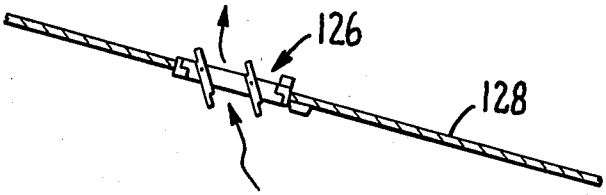
FIG. 8 shows a type of ceiling construction which requires that the smoke control valve of FIGS. 2 and 3 be modified for adaptation thereto.

It is further to be understood that my invention is not limited to use in the particular types of roof or ceiling construction shown in FIGS. 6 and 7, nor to the particular types of smoke control device structure adapted for use in the vertical position. Rather, it is within the scope of those having ordinary skill in the art to provide alternative louver drive means for operating the louvers of embodiments of my smoke control device invention which can be mounted in a pitched roof 128 (FIG. 8).

It will, of course, be apparent to those having ordinary skill in the art that when smoke control devices of my invention are employed in the ceilings of hotel corridors and the like they must communicate with above-ceiling smoke exhaust ducts. The provision of such above-ceiling smoke exhaust ducts in both old and new building constructions is within the scope of those having ordinary skill in the building design art, informed by the present disclosure.

Figure 9:
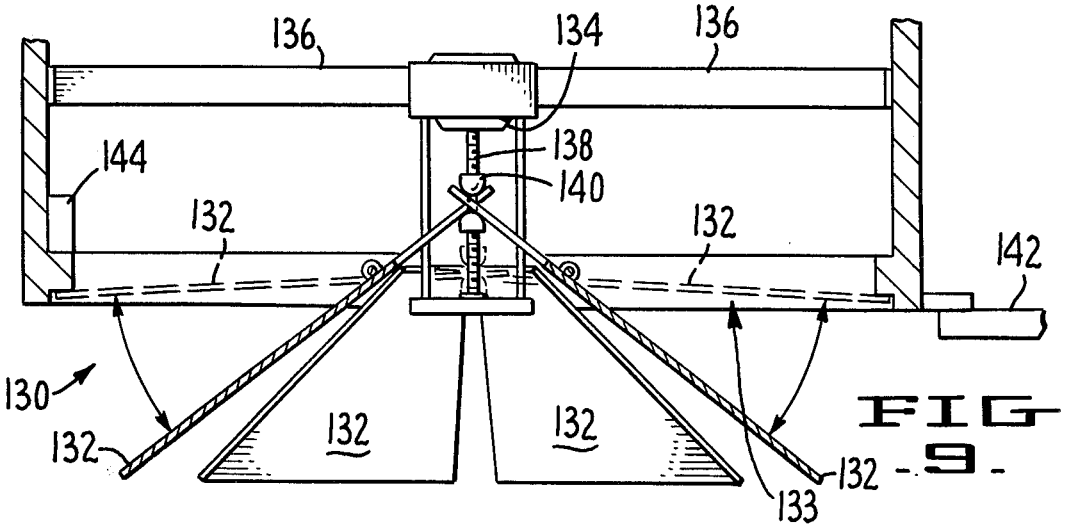
FIG. 9 shows an alternative smoke control valve structure embodying my invention.

Referring now to FIG. 9, there is shown an alternative form of smoke control device 130 embodying my invention in which the vanes 132 which together close the central air and smoke opening 133 are collectively driven between their open position (solid lines) and their closed position (dashed lines) by a servo motor 134, which is itself maintained in said central opening by means of a spider 136. As will be seen by those having ordinary skill in the art, informed by the present disclosure, servo motor 134 (through suitable gearing, not shown) rotates a lead screw 138 with which is engaged a nut 140. The inner ends of the vanes 132 are all engaged with nut 140 in such manner as to be opened and closed as nut 140 advances or retreats along lead screw 138. Smoke control device 130 also comprises a smoke detector 142 and a temperature detector 144 which are interconnected with servo motor 134 for the opening and closing of vanes 132 in accordance with principles of my invention explained hereinabove in connection with the smoke control device of FIGS. 2 and 3.

That is to say, when vanes 132 are in their closed position smoke detector 142 responds to smoke exceeding a predetermined minimum in its vicinity by providing a signal to an intermediate circuit (not shown) which then causes servo motor 134 to so rotate lead screw 138 as to drive vanes 132 from their closed position to their open position; and when vanes 132 are in their open position and temperature detector 144 senses a temperature in excess of a predetermined limit, e.g., 135° F., then temperature detector 144 provides a signal to said intermediate circuit, which then causes servo motor 134 to rotate lead screw 138 in the opposite direction, and thus to drive vanes 132 to their closed position.

The provision of said intermediate circuit and related means for thus controlling the opening and closing of vanes 132 in response to signals from smoke detector 142 and temperature detector 144, including limit setting switch means for limiting the travel of vanes 132 toward their extremes of motion, is within the scope of those having ordinary skill in the art, informed by the present disclosure.

Figure 10:
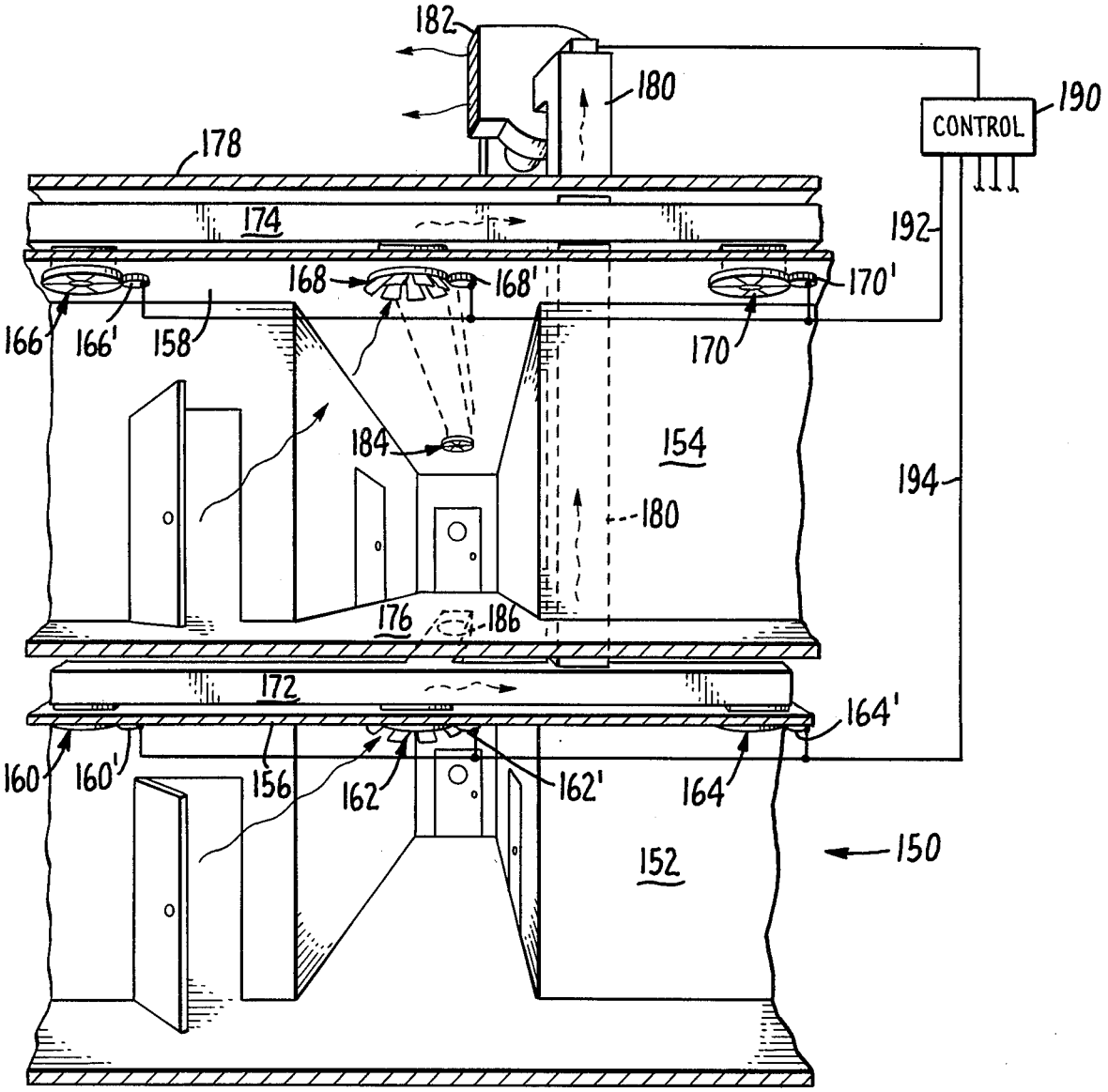
FIG. 10 shows a smoke control valve system of my invention in a hotel or the like in which the smoke control valves are of the type shown in FIG. 9.

Referring now to FIG. 10, there is shown a portion of a multi-story building equipped with a smoke control system embodying my invention and comprising smoke control devices of the type shown in FIG. 9.

As seen in FIG. 10, building 150 is two-story building comprising a lower corridor 152 and an upper corridor 154. The ceiling 156 of corridor 152 is provided with a plurality of the smoke control devices of FIG. 9, 160, 162, 164, and the ceiling 158 of corridor 154 is provided with a plurality of the smoke control devices of FIG. 9, 166, 168, 170.

Each of the smoke control devices 160, 162, 164 communicates directly with the interior of a horizontal duct 172, and each of the smoke control devices 166, 168, 170 communicates directly with the interior of a horizontal duct 174. Duct 172 is located between the ceiling 156 of corridor 152 and the floor 176 of corridor 154. Duct 174 is located between the ceiling 158 of corridor 154 and the roof 178 of building 150.

Ducts 172 and 174 are interconnected by means of a vertical duct 180 which itself passes through roof 178 and is joined to an exhaust fan 182 which is mounted on roof 178.

Thus, it will be seen by those having ordinary skill in the art, informed by the present disclosure, that every smoke control device 160, 162, 164, 166, 168, 170, 184, 186, etc., mounted in the ceilings of the corridors of building 150 is in direct communication with a duct system which terminates at exhaust fan 182 and can be continuously exhausted by the operation of exhaust fan 182.

In the manner taught hereinabove, each smoke control device comprises a smoke detector (e.g., 166', 168') and a temperature detector (not shown) by means of which the vanes thereof are opened or closed in accordance with the above-stated principles of my invention.

As further indicated in FIG. 10, the operation of exhaust fan 182 is controlled by a control unit 190.

Control unit 190 is interconnected with all of the smoke control devices 160, 162, etc., by means of signal conductors 192, 194, etc., and thus is provided with a smoke signal whenever one or more of the smoke control devices is open.

By way of example only, such a smoke signal may be provided by the closed position limit setting switch of one of the smoke control devices, which grounds its associated signal conductor when and only when its associated vanes are displaced from their closed position.

Whenever control unit 190 receives a smoke signal from one of the smoke control devices it closes a relay which provides driving power to exhaust fan 182, and thus the smoke which brought about the production of the smoke signal is withdrawn from the vicinity of the smoke control device from which the smoke signal originated.

Further, in accordance with the principles of my invention as embodied in the system of FIG. 10, the opened smoke control device which brought about the smoke signal which caused control device 190 to activate exhaust fan 182 will be closed in response to a signal from its temperature detector if its temperature detector senses a temperature of greater than, say, 135° F. in its immediate vicinity. When this smoke control device is thus closed, and assuming that no others are open, its associated signal conductor will be disconnected from ground, and thus control unit 190 will be caused to deactivate or shut down exhaust fan 182, so that this smoke control device does not exacerbate the fire which produced the smoke which caused it to open.

It is to be understood that while the smoke control system of FIG. 9 utilizes ducts which were originally incorporated in building 150, or were retrofitted to building 150, my invention also embraces systems in which existing sub-floor spaces are utilized as the smoke removal ducts of the system, without the provision of ducts specially dedicated to the purpose. As will be understood by those having ordinary skill in the art, however, other smoke control systems embracing my invention may use existing sub-floor spaces for the horizontal ducts, which sub-floor spaces are interconnected with the roof-mounted exhaust fan by means of a vertical duct or duct system which is specially provided for the purpose.

Figure 11:
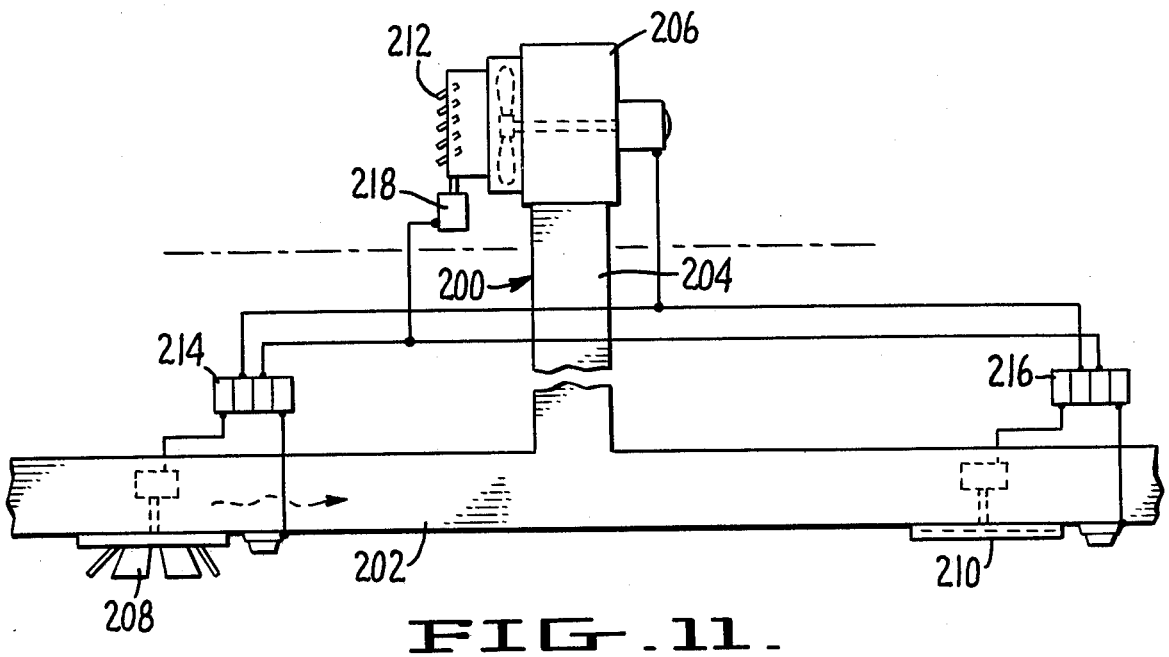
FIG. 11 is a schematic representation, in part only, of a smoke control system embodying my invention.

Referring now to FIG. 11, there is shown a smoke control system embodying my invention in which an existing heating, ventilating, and air-conditioning system is used as the smoke exhaust duct portion of the smoke control system. In FIG. 11 the existing heating, ventilating, and air-conditioning system is referred to by the reference numeral 200.

As seen in FIG. 11, heating, ventilating, and air-conditioning system 200 comprises a horizontal duct 202 and a vertical duct 204.

It is to be particularly understood in connection with this embodiment of my invention that exhaust fan 206 which serves to exhaust ducts 202 and 204 is not the exhaust fan of the heating, ventilating, and air-conditioning system.

It is further to be understood that exhaust fan 206 is provided with an electrically operated louver or louvers 212 by means of which the egress of air from exhaust fan 206 can be blocked. The function of louver or louvers 212 is to prevent exhaust fan 206 from interfering with the operation of the heating, ventilating, and air-conditioning system when there is no fire in the building.

As seen in FIG. 11, any one of the intermediate circuits or control circuits 214, 216, etc., of the smoke control devices 208, 210, etc., can cause the electrical louver operating means 218 to open the louvers 212. The intermediate circuits 214, 216, etc., function to open louvers 212 whenever one of their associated smoke control units is open, i.e., its vanes are in their open position.

Thus, it will be seen by those having ordinary skill in the art, informed by the present disclosure, that louvers 212 function to prevent the leakage of heated or cooled air from the heating, ventilating, and air-conditioning system via exhaust fan 206 when there is no fire in the equipped building.

When, however, there is a fire in the equipped building, and one of the smoke control devices is open, e.g., smoke control device 208 in FIG. 11, then the associated intermediate circuit or control circuit 214 causes louver operating device 218 to open louvers 212, and exhaust fan 206 can be energized to withdraw smoke from the ducting system 202, 204, etc.

As will also be understood by those having ordinary skill in the art, exhaust fan 206 can be conveniently located immediately adjacent the exhaust fan of the heating, ventilating, and air-conditioning system, so that they can share substantially all of a corresponding vertical duct 204.

Figure 12:
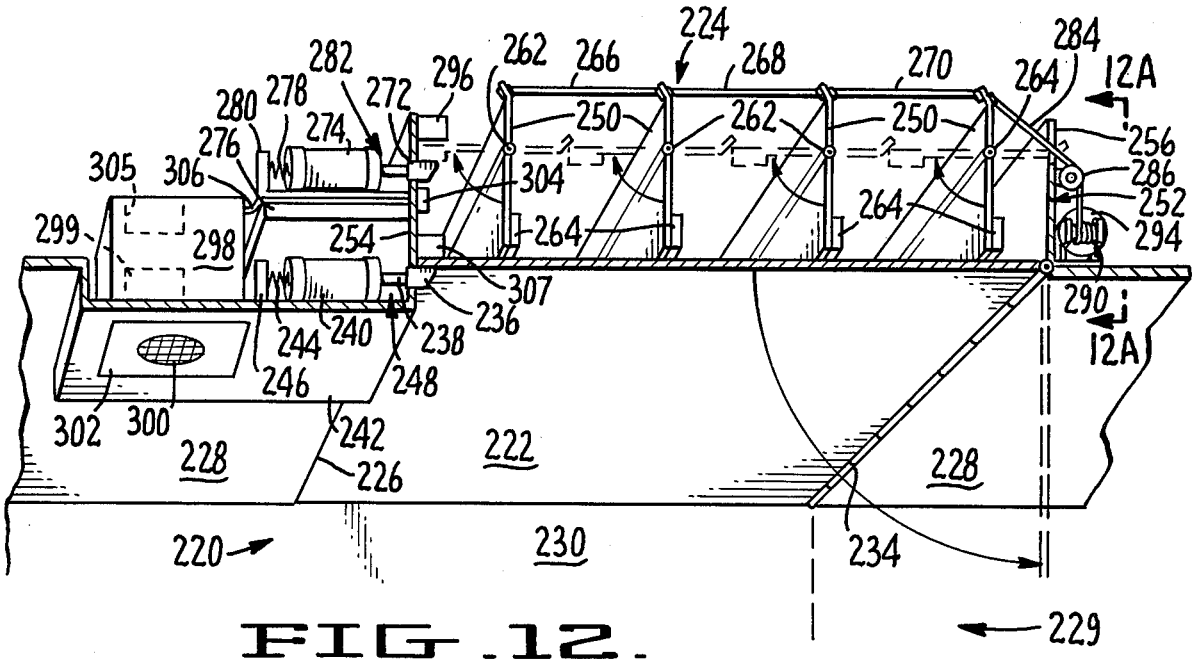
FIG. 12 is a pictorial representation in vertical section of a two-element smoke and fire control valve embodying my invention.

Referring now to FIG. 12, there is shown a two-element smoke control device 220 which is part of a fire control system embodying my invention.

In accordance with a particular feature of my invention, smoke control device 220 comprises two valving elements 222, and 224.

As seen in FIG. 12, valving element 222 is a single flap or trap door which serves to tightly close an opening 226 in the ceiling 228 of the corridor 229 in which smoke control device 220 is employed.

In accordance with another feature of my invention, opening 226 and valving element 222 both extend substantially completely across from one wall 230 to the opposite wall 232 of corridor 229.

Figure 13:
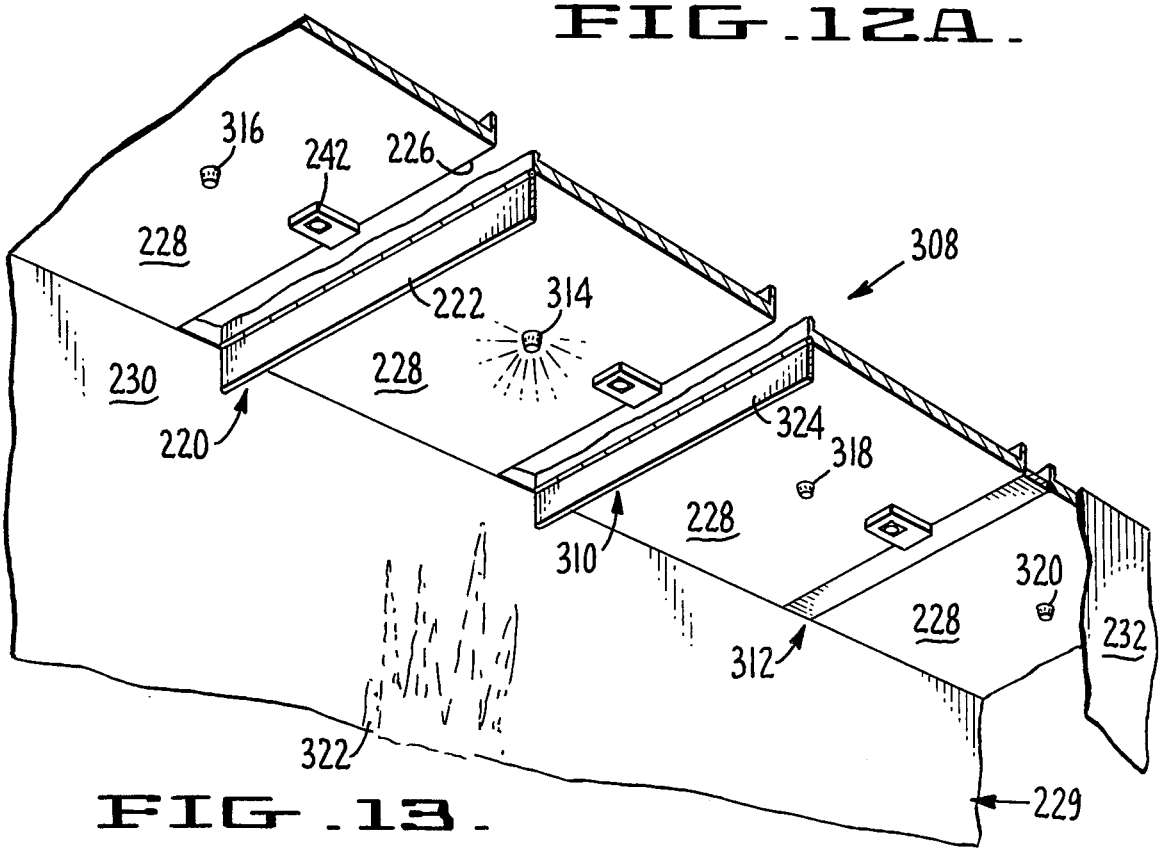
FIG. 13 is a pictorial representation of a corridor ceiling installation of a plurality of two-element smoke and fire control valves of my invention and the sprinkler heads with which they coact in accordance with the principles of my invention.

For clarity of illustration, smoke control device 220 and corridor 229 are partially shown in FIG. 13. In FIG. 13, however, valving element 222 is shown in its open position, i.e., in the position in which it does not serve to block opening 226.

As further seen in FIG. 13, valving element 222, when in its open position, serves as a curtain board, i.e., serves to prevent the travel of smoke and hot gases along the ceiling of corridor 229. For this reason, valving element 222 will sometimes be called the "curtain board" herein. It is to be understood that this function of valving element 222 is a particular feature of my invention.

Returning now to FIG. 12, it will be seen that curtain board 222 is attached along one of its edges to the movable part of a hinge 234 which extends from wall 230 to wall 232. The fixed part of hinge 234 is affixed to the frame of smoke control device 220.

As also seen in FIG. 12, the edge of curtain board 222 opposite hinge 234 is supported by a latching member 236. Latching member 236 is affixed to one end of the armature 238 of solenoid 240, so that latching member 236 can be withdrawn, and curtain board 222 allowed to drop to its open position, as seen in FIG. 13, when solenoid 240 is energized. As also seen in FIGS. 12 and 13, solenoid 240 is mounted in a tray 242 which depends from ceiling 228.

As also seen in FIG. 12, latching member 236 passes through and is guided by a close-fitting opening in a wall of tray 242. Further, a compression spring 244 is affixed to the end of solenoid 240 opposite latching member 236, and the opposite end of compression spring 244 is affixed to a stationary abutment member 246, which is itself affixed to the bottom of tray 242. Solenoid 240 itself is slidably mounted on the bottom of tray 242. Yet further, a stop 248 is also affixed to the bottom of tray 242, and is so located as to limit the travel of solenoid 240 away from stationary abutment member 246 under the urging of compression spring 244.

Thus, it will be seen that whenever curtain board 222 is in its open or dropped position (FIG. 13) it can be returned to its normal or closed position (FIG. 12) by manually deflecting and raising its outer (non-hinged) side until it engages with and is supported by latching member 236.

Returning now to FIG. 12, it will be seen that valving element 224 comprises a set of louvers 250 which are pivotably mounted in a frame 252.

Frame 252, to which curtain board 222 is also affixed by hinge 234, is the principal body member of smoke control device 220. Frame 252 comprises two transverse members 254 and 256, the adjacent ends of which are interconnected, respectively, by two longitudinal members 258, 260 (not shown), thus forming a rectangular frame. When mounted in ceiling 228 behind opening 226, as shown, the transverse members 254, 256 of frame 252 extend substantially from wall 230 to wall 232, while longitudinal member 258 is parallel to and substantially in contact with the outer face of wall 230, and longitudinal member 260 is parallel to and substantially in contact with the outer face of wall 232.

Frame 252 is fixed in position directly behind ceiling opening 226, preferably in such manner that curtain board 222 is flush with and appears to be a part of ceiling 228. Many ways of thus mounting frame 252 will occur to those having ordinary skill in the art without the exercise of invention, depending upon the construction of the ceiling in which frame 252 is to be mounted.

As seen in FIG. 12, each louver 250 comprises an elongated pocket containing a pivot rod 262. Each pivot rod 262 is fixedly mounted in frame 252, having a first end received in a socket in frame wall 258 and a second, opposite end received in a socket in frame wall 260. Thus, each louver 250 is mounted in frame 252 for pivoting about the axis of its pivot rod 262, between an open position (solid lines in FIG. 12) and a closed position (dashed lines in FIG. 12).

As also seen in FIG. 12, each louver 250 is provided with a counterweight 264 affixed to it along its lower edge. Thus, each counterweight 264 biases its associated louver 250 toward its open position.

Further, the adjacent pairs of louvers 250 are pivotably interconnected by means of rigid links 266, 268, 270, and thus all of the louvers 250 travel between their open and closed positions in unison.

As also seen in FIG. 12, a latching member 272 is provided for latching coordinated louvers 250 in their closed position. Latching member 272 and its operating assembly are constructed and arranged in substantially the same way as latching member 236 and its operating assembly 238, 240, 244, 246, 248; the operating assembly of latching member 272 being mounted on a shelf 276 which is affixed to frame wall 254, and an opening for latching member 272 being provided in that frame wall. Thus, it will be seen that latching member 272 can be substantially completely withdrawn from said opening by solenoid 274, so that louvers 250 are allowed to drop under the urging of their respective counterweights 264, and that solenoid 274 is movably mounted on shelf 276. Solenoid 274 is resiliently urged against stop 282 by compression spring 278, the opposite end of which from solenoid 274 is affixed to a stationary member 280, which like stop 282 is affixed to shelf 276.

Thus, it will be seen that whenever louvers 250 are drawn into their closed position by cable 284, as hereinafter explained, and solenoid 274 is not energized, they will be retained in that position until solenoid 274 is energized.

It should be noted at this point that, in accordance with the principles of my invention, the open top face of frame 252 is either affixed to the edges of a corresponding opening in an exhaust duct (not shown in FIG. 12) or is open to a space above ceiling 228 which acts as part of an exhaust duct.

As seen in FIG. 12, cable 284 is affixed to the top edge of the rightmost louver 250 in FIG. 12, and thence passes through an opening in frame wall 256 and over a pulley 286 which is itself pivotably mounted on the outside face of frame wall 256.

Figure 12A:
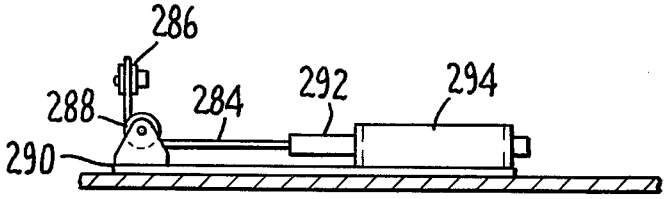
FIG. 12*a* is a partial view of the two-element smoke and fire control valve of FIG. 12, taken on line 12*a*–12*a*.

As seen in FIG. 12*a*, cable 284 then passes beneath a pulley 288, which is itself pivotably affixed to a shelf 290 extending outwardly from frame wall 256, just above ceiling 228. One end of cable 284 is affixed to one end of the armature 292 of a solenoid 294. Solenoid 294 is affixed to shelf 290. Thus, it will be seen that when the louvers 250 are in their open position they can be raised to their closed position by the energization of solenoid 294. As explained above, the louvers 250 are locked in their closed position by latching member 272 whenever they are raised to their closed position, provided, of course, that solenoid 274 is not energized at that time.

Returning to FIG. 12, it will be seen that smoke control device 220 further comprises a switch, affixed to frame wall 254 in such manner as to be actuated whenever louvers 250 are in their closed position, and otherwise unactuated. The function of switch 296 will be explained hereinafter.

Smoke control device 220 further comprises a control unit 298, mounted in tray 242.

Control unit 298 comprises a smoke detector 299 of well-known type, which is exposed to the air immediately adjacent opening 226 by way of a screened opening 300 in a service plate 302, which is itself secured in an opening in the bottom of tray 242.

Smoke control device 220 also comprises a temperature detector 304, which is mounted on frame wall 254, where it is exposed to smoke and hot gases which pass through frame 252 during the operation of smoke control device 220. Temperature detector 304 is interconnected with a control circuit 305 in control unit 298 by way of a cable 306 (FIG. 12).

Temperature detector 304 is constructed and arranged to supply control circuit 305 with a first temperature signal value whenever the temperature of the air, etc., in frame 252 is less than a predetermined temperature level, e.g., 135° F., and to supply control circuit 305 with a second temperature signal value whenever the temperature of the air, etc., in frame 252 is greater than said predetermined temperature level.

Smoke detector 299 is constructed and arranged to supply control circuit 305 with a first smoke signal value whenever the air outside screened opening 300 is substantially free of smoke, and to supply control circuit 305 with a second smoke signal value whenever the air outside screened opening 300 contains more smoke than a predetermined amount, which predetermined amount is substantially equal to the predetermined amount set in common smoke detectors of well-known type.

Control circuit 305 is also interconnected with solenoids 240, 274, and 294, which it serves to energize at appropriate times determined in accordance with the then-existing values of said smoke signal and said temperature signal.

In the preferred embodiment of FIGS. 12, 12*a*, and 13, control circuit 305 is supplied with power by way of a connection to an existing alternating current power line, and includes a rectifier for providing direct current with which to operate the solenoids.

In other embodiments of the fire control system of my invention the control circuit may include a trickle-charged battery to provide solenoid operating power when the line power is lost.

Further, in other embodiments of my invention, the solenoids may be replaced by compressed air cylinders or the like which are operated from an accumulator which is itself charged by a small compressor powered by alternating voltage power from an existing power line.

The provision of all such arrangements for providing power for operating valving elements 222 and 224 is within the scope of those having ordinary skill in the art, without the exercise of invention, as is the provision of suitable circuits to be used as control circuit 305.

Switch 296 is considered to be a part of control circuit 305, as is curtain board switch 307.

Before considering the operating cycle of smoke control device 220, the fire control system 308 of which several such devices are a part will be considered in detail. It is to be particularly understood that such fire control systems and their method of operation constitute principal features of my invention.

Referring now to FIG. 13, there is shown a part only of fire control system 308.

Fire control system 308 comprises smoke control device 220 and several other substantially identical smoke control devices 310, 312, etc., all similarly mounted in the ceiling 228 of a building corridor 229. In general, fire control system 308 will further include many more smoke control devices substantially identical to smoke control device 220, all similarly mounted in the ceilings of a number of related building corridors.

Returning to FIG. 13, it will be seen that a conventional sprinkler head is mounted between smoke control devices 220 and 310. In general, a conventional sprinkler head 314, 316, 318, 320, etc., will be mounted between each pair of smoke control devices throughout the fire control system. (It is to be understood that the proportions of parts and the distances therebetween between as shown in FIG. 13 are not necessarily equal to those found in any actual installation of a fire control system of my invention, since the proportions, etc., of FIG. 13 are distorted for purposes of illustration and ready comprehension.)

Given the arrangement of fire control system parts just described let it be assumed that a fire 322 has just started in corridor 229.

The smoke emenating fire 322 operates smoke control devices 220 and 310, causing curtain boards 220 and 324 to drop into their operative positions, and further causing the exhaust fan at the outlet of the associated duct system to be energized, whereby the smoke from fire 322 is exhausted from corridor 229, since louvers 250, and the corresponding louvers in all of the other smoke control devices of the fire control system, are normally in their open position.

As fire 322 grows in intensity, if it does, the increased temperature of the air and other gases passing through smoke control device 310 causes the louvers of its upper valving element to be closed and thus the build-up of hot air and gases confined between curtain boards 222 and 324 rapidly rises in temperature to the point at which the heat sensitive element of sprinkler head 314 fuses, and sprinkler head 314 functions to suppress fire 322. The melting point of the heat sensitive element of sprinkler head 314 is much sooner reached than would be the case if curtain boards 222 and 324 were not present.

Further, in accordance with another feature of my invention, the cooling of the air and other gases trapped below the closed louvers of smoke control device 310 causes these louvers to reopen, whereupon the remaining smoke in corridor 229 is exhausted through the duct system, the pressure in which is reduced by the operation of the associated exhaust fan. (The exhaust fan is arranged to operate when and only when the louvers of at least one smoke control device of the system are open.)

Figure 14:
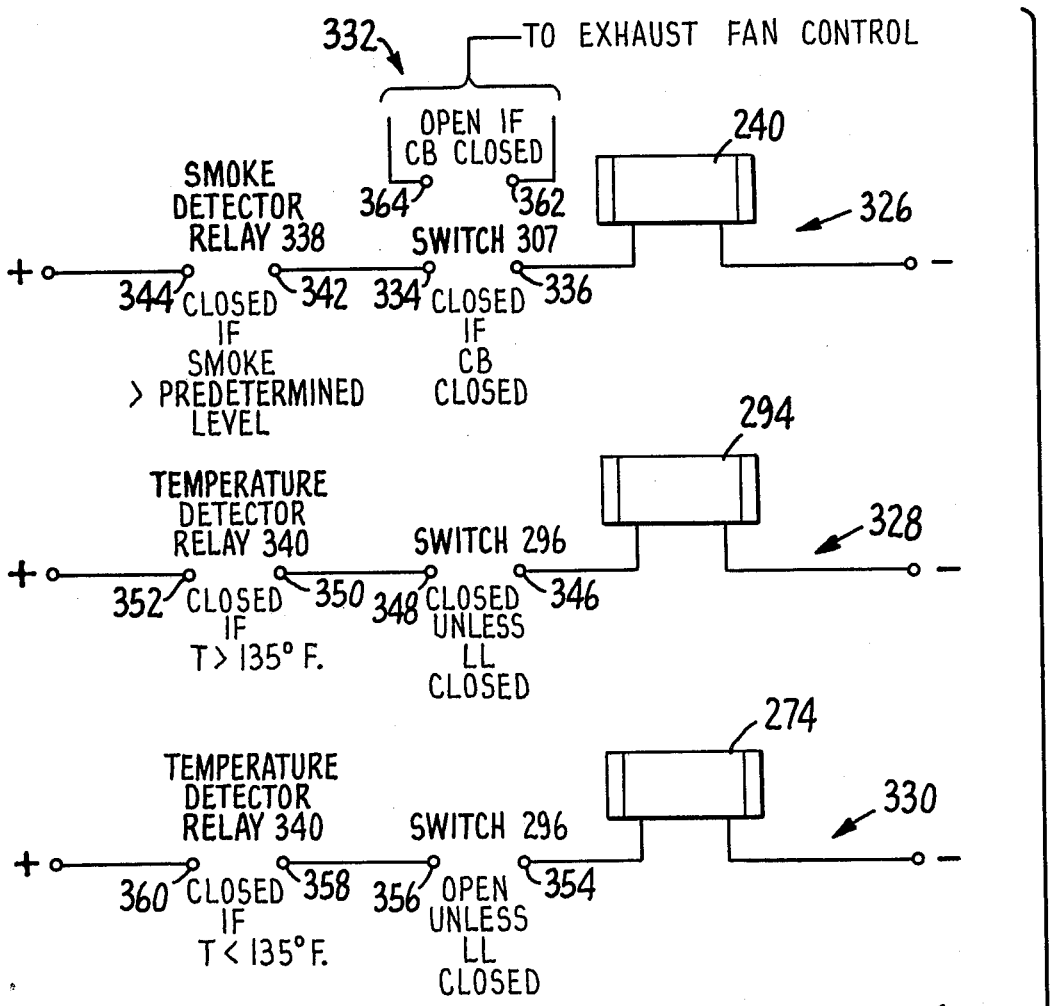
FIG. 14 is a schematic representation of the control circuit of the two-element smoke and fire control valve of my invention shown in FIG. 12.

Referring now to FIG. 14, the operation of the control circuit 305 of smoke control device 220 will now be described in detail.

As there seen, control circuit 305 comprises three principal branches, 326, 328, 330, and an exhaust fan control connection 332. Each of these branches is connected between the positive and negative terminals of the rectified direct current power supply referred to hereinabove.

Branch 326 comprises the curtain board unlatching solenoid 240, a pair of terminals 334, 336 of curtain board switch 307 which are closed if and only if the curtain board is in its closed position, and a pair of terminals 342, 344 of a smoke detector relay 338 which is so operated by smoke detector 229 and associated circuitry as to be closed if the amount of smoke detected exceeds the abovesaid predetermined amount of smoke, and otherwise open, all connected in series.

Branch 328 comprises the louver closing solenoid 294, a pair of terminals 346, 348 of louver switch 296 which are closed unless the louvers 250 are closed, and a pair of terminals 350, 352 of a temperature detector relay 340 which is so operated by temperature detector 304 and associated circuitry as to be closed if the temperature detected exceeds 135° F., and otherwise open, all connected in series.

Branch 330 comprises the louver unlatching solenoid 274, a pair of terminals 354, 356 of louver switch 296 which are open unless the louvers 250 are closed, and a pair of terminals 358, 360 of a temperature detector relay 340 which are closed if the temperature detected is less than 135° F., and otherwise open, all connected in series.

As will now be evident to those having ordinary skill in the art, informed by the present disclosure, control circuit 305 operates as follows:

When excess smoke is detected by smoke detector 299 and curtain board 22 is closed, branch circuit 326 is completed and solenoid 240 is energized, permitting curtain board 222 to drop into its operative position, and thus opening smoke control device 220 to its associated exhaust duct, since louvers 250 are normally open. When curtain board 222 drops the terminals 362, 364, of switch 307 are closed, thus causing the exhaust fan associated with the exhaust duct system to operate.

When temperature detector 304 senses air or gas temperature in excess of 135° F. and louvers 250 are open, branch circuit 328 is completed and solenoid 294 is energized, causing louvers 250 to be closed. As soon as louvers 250 are closed the terminals 346 and 348 of switch 296 are opened (disconnected), thus protecting solenoid 294 from over current.

When the fire which caused the temperature rise resulting in the closing of the louvers 250 is suppressed by the associated sprinkler system, and the air and other gases near temperature detector 304 have cooled below 135° F., the contacts 358, 360 of temperature detector relay 340 connected in branch circuit 330 are closed (interconnected), branch circuit 330 is completed, and solenoid 274 is energized, releasing louvers 250 to reopen in response to the urging of their counterweights.

As part of the clean-up process after the fire which resulted in the operation of smoke control device 220, as just described, curtain board 222 will be manually raised to its closed position, and automatically latched there by latching member 236, thus actuating switch 307 and resetting smoke control device 220 for a repetition of the same operating cycle whenever necessary.

It will thus be seen that the objects set forth above, among those made apparent from the preceding description, are efficiently attained, and since certain changes may be made in the above constructions and the methods carried out thereby without departing from the scope of my invention, it is intended that all matter contained in the above description of shown in the accompanying drawings shall be interpreted as illustrative only, and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A smoke control system, comprising:

smoke control valve means;

smoke responsive means for opening said valve means in response to the presence of smoke in the vicinity of said valve means;

temperature responsive means for closing said valve means in response to elevated temperature in the vicinity of said valve means; and means for initiating the operation of smoke extracting means for extracting smoke from the vicinity of said valve means through said valve means.

2. A smoke control system as claimed in claim 1 wherein said valve means is disposed in an opening communicating between a passageway of a building and a smoke evacuating duct.

3. A smoke control system as claimed in claim 2 in which said smoke exracting means comprises said duct and an exhaust fan for withdrawing smoke therefrom, said exhaust fan being controlled by said operation initiating means.

4. A smoke control system comprising a plurality of smoke control valve means which control the passage of smoke through the same smoke passage, and in which one of said smoke control valve means also functions as a curtain board, further comprising smoke responsive means for opening said one of said smoke control valve means and enabling it to function as a curtain board in response to the presence of smoke in the vicinity of said smoke control system, and further comprising temperature responsive means for closing another one of said smoke control valve means in response to the elevation of the temperature of gases passing through said smoke control valve means, and means for re-opening said another one of said smoke control valve means in response to the lowering of the temperature of gases adjacent said smoke control valve means.

5. A smoke control system, comprising:

smoke control louver valve means;

smoke responsive means for opening said valve means in response to the presence of smoke in the vicinity of said valve means;

temperature responsive means for closing said valve means in response to elevated temperature in the vicinity of said valve means; and means for initiating the operation of smoke extracting means for extracting smoke from the vicinity of said valve means through said valve means.

6. A smoke control system as claimed in claim 5 wherein said valve means is disposed in an opening communicating between a passageway of a building and a smoke evacuating duct.

7. A smoke control system as claimed in claim 6 in which said smoke extracting means comprises said duct and an exhaust fan for withdrawing smoke therefrom, said exhaust fan being controlled by said operation initiating means.

* * * * *